US005582387A

United States Patent [19]

Kolton et al.

[11] Patent Number: 5,582,387

[45] Date of Patent: Dec. 10, 1996

[54] HANGER AND HANGER COMPOSITE FOR PROMOTIONAL DISPLAY

[75] Inventors: Chester Kolton, Westfield; Stuart S. Spater, Livingston, both of N.J.

[73] Assignee: B&G Plastics, Inc., Newark, N.J.

[21] Appl. No.: 549,084

[22] Filed: Oct. 27, 1995

[51] Int. Cl.[6] ..... A47G 29/00

[52] U.S. Cl. ..... 248/690; 211/118; 223/85; 223/87; 223/89; 248/316.5; 248/340

[58] Field of Search ..... 248/339, 340, 248/690, 316.5, 215, 300; 24/113, 118; 223/94, 89, 85, 87, 88, DIG. 1

[56] References Cited

U.S. PATENT DOCUMENTS

| | | | |
|---|---|---|---|
| 4,023,762 | 5/1977 | Batts et al. | 248/340 |
| 5,064,162 | 11/1991 | Jondelius | 248/300 X |
| 5,129,617 | 7/1992 | MacWilliamson | 211/13 X |
| 5,222,638 | 6/1993 | Kolton et al. | 223/87 |
| 5,421,494 | 6/1995 | Kolton et al. | 223/85 |
| 5,429,284 | 7/1995 | Kolton et al. | 223/87 X |
| 5,452,828 | 9/1995 | Kolton et al. | 223/88 |
| 5,501,378 | 3/1996 | Kolton et al. | 223/87 |

FOREIGN PATENT DOCUMENTS

| | | | |
|---|---|---|---|
| 3729990 | 3/1989 | Germany | 248/339 |

*Primary Examiner*—Ramon O. Ramirez
*Assistant Examiner*—Michael J. Turgeon
*Attorney, Agent, or Firm*—Robin, Blecker, Daley & Driscoll

[57] ABSTRACT

A primary hanger has a hook portion for receiving a hanging rod and a first retention structure, a fold line segment depending from the hook portion and a sideward opening communicating with the hook portion opening and a flap segment depending from the fold line segment, the flap segment defining a second retention structure cooperative with the first retention portion to retain the flap segment with the hook portion upon folding of the flap segment about the fold line segment. The flap segment and the hook portion define a passage therebetween upon the folding of the flap segment about the fold line segment. A secondary hanger has an upper part which is sized to enter the sideward opening of the flap segment and which has openings therethrough registrable with the first and second retention structures to be captured thereby upon folding of the flap segment about the fold line segment, the second hanger thereby being hung from the first hanger.

17 Claims, 8 Drawing Sheets

HANGER AND HANGER COMPOSITE FOR PROMOTIONAL DISPLAY

FIELD OF THE INVENTION

This invention relates generally to hangers and to hanger composites for display of secondary, promotional articles with primary, for sale, articles.

BACKGROUND OF THE INVENTION

In one prior composite hanger, applicants provide a hanger composite including a first hanger having a hook portion for releasable securement to a display rod and an elongate foldable tail portion, the tail portion defining a latching opening therethrough and a projection extending outwardly of the tail portion to a given extent for latching disposition in the latching opening, and a second hanger assembled with the first hanger and defining a compartment for containment of an article, the second hanger having an opening therethrough configured complementally with the tail portion of the first hanger and enabling the assembly of the first and second hangers.

The first hanger defines a belt buckle prong receiving opening in the tail portion, the tail portion preferably being configured to dispose the second hanger distal from the belt buckle prong receiving opening. The second hanger desirably defines a fold line aside the second hanger opening, whereby the second hanger may be adjusted such that the belt and the second hanger are disposed in vertically parallel manner.

In a further prior composite hanger applicants provide, in combination, a belt having a buckle, a belt blank secured with the buckle and a retaining member secured with the belt blank adjacent the buckle for retaining a portion of the belt blank issuing from the buckle upon belt buckling and a hanger having a hook portion disposed on the belt retaining member, the hook portion defining locking structure for capturing the belt retaining member in the hook portion, and a compartment portion depending from the hook portion, the compartment being adapted for containment of an article to be marketed with the belt.

More particularly, the hanger hook portion has first and second mutually facing parts and a third part extending transversely of the first and second mutually facing parts and joining them, the compartment portion being bounded in part by the second mutually facing part.

The foregoing composite hangers of applicants are the subjects of U.S. Pat. Nos. 5,421,494 and 5,452,828.

Applicants' copending and commonly-assigned U.S. patent application Ser. No. 279,280 is of further background interest to the subject invention. Therein, applicants provide a garment hanger comprised of a one-piece body having a hook portion for the receipt of a display rod, a central portion depending from the hook portion, the body defining in the central portion an opening therethrough and a garment support member disposed in the opening and movable relative to the body and a lower portion defining a fold line segment depending from the central portion and a flap segment depending from the fold line segment. The central portion, the fold line segment and the flap segment jointly defining a slot in the body which opens into a margin of the body.

The central portion and the flap segment define coactive means for retaining the flap segment against the central portion on folding of the flap segment about the fold line segment.

The fold line segment is disposed contiguously with an interior end of the slot and provides cantilever support for the flap segment.

SUMMARY OF THE INVENTION

In the present invention, applicants have as their principal object the provision of further hangers and composite hanger arrangements.

In attaining the foregoing object to provide further hangers, the invention provides a primary hanger comprised of a one-piece body having a first part defining a hook portion having an opening extending therethrough for receiving a hanging support member and defining first retention structure, a second part depending from the hook portion and defining a fold line segment and a sideward opening communicating with the hook portion opening and a third part comprising a flap segment depending from the fold line segment, the flap segment defining second retention structure cooperative with the first retention portion to retain the flap segment with the hook portion upon folding of the flap segment about the fold line segment. The flap segment and the hook portion define a passage therebetween upon the folding of the flap segment about the fold line segment.

In attaining the foregoing object to provide further hanger composites, the invention provides a first (primary) hanger of the foregoing type, wherein the first and second retention structures include transversely spaced retaining elements respectively upwardly and downwardly bounding the flap segment, and a second (secondary) hanger having an upper part which is sized to enter the sideward opening of the flap segment and which has openings therethrough registrable with the retaining elements of the first and second retaining structures to be captured thereby upon folding of the flap segment about the fold line segment, the second hanger thereby being hung from the first hanger.

In practicing the invention in its composite hanger aspect, the first hanger may otherwise be of any type which includes a hook portion, a fold line segment having a sideward opening and a flap segment, wherein there are first and second retention structures, each including transversely spaced retaining elements, respectively upwardly and downwardly bounding the flap segment.

The foregoing and other objects and features of the invention will be further understood from the following detailed description thereof and from the drawings, wherein like components are identified by common reference numerals throughout.

DETAILED DESCRIPTION OF PREFERRED EMBODIMENTS AND PRACTICES

Figure 1:
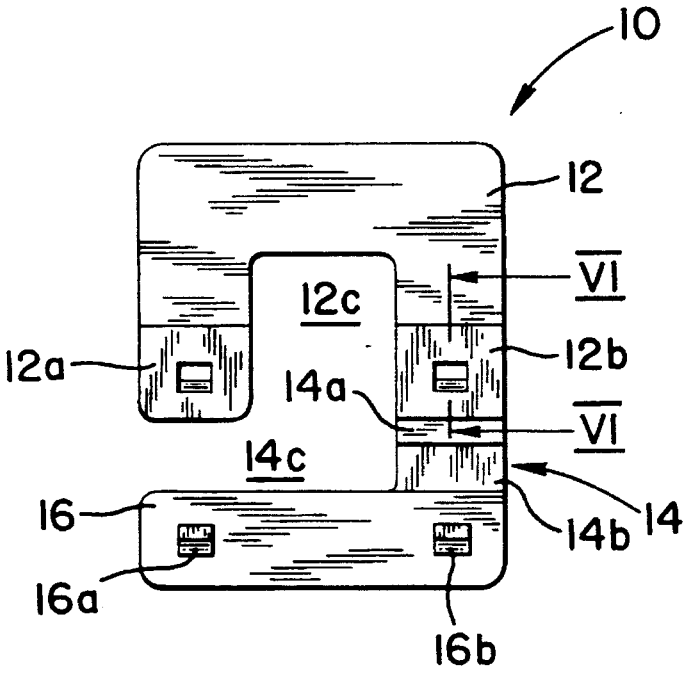
FIG. 1 is a front elevation of a primary hanger in accordance with the invention in unfolded condition.
Figure 2:
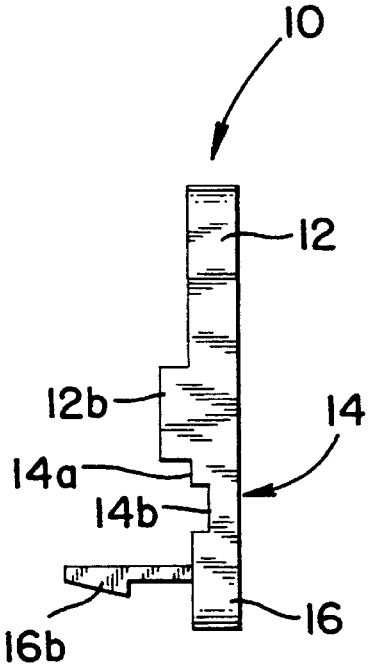
FIG. 2 is a right side elevation of the hanger of FIG. 1.

Referring to FIGS. 1 and 2, primary hanger 10 is comprised of a one-piece body of plastic having a first part 12 defining a hook portion. At lower extents thereof, part 12 has apertured increased thickness, retaining elements 12*a* and 12*b* constituting first retention structure and also defines hanging rod receiving opening 12*c*.

Hanger 10 includes a second part 14 having diverse thickness portions 14*a* and 14*b* defining a fold line segment of the hanger. Opening 14*c* communicates with opening 12*c* and opens into the left side margin of hanger 10.

Third part 16 of hanger 10 is a flap segment depending from the fold line segment, the flap segment defining second retention structure configured as retaining elements 16*a* and 16*b* projecting outwardly of hanger 10 and cooperative with the first retention structure to retain the flap segment with the hook portion upon folding of the flap segment about the fold line segment. The flap segment and the hook portion define a passage therebetween upon the folding of the flap segment about the fold line segment.

Figure 3:
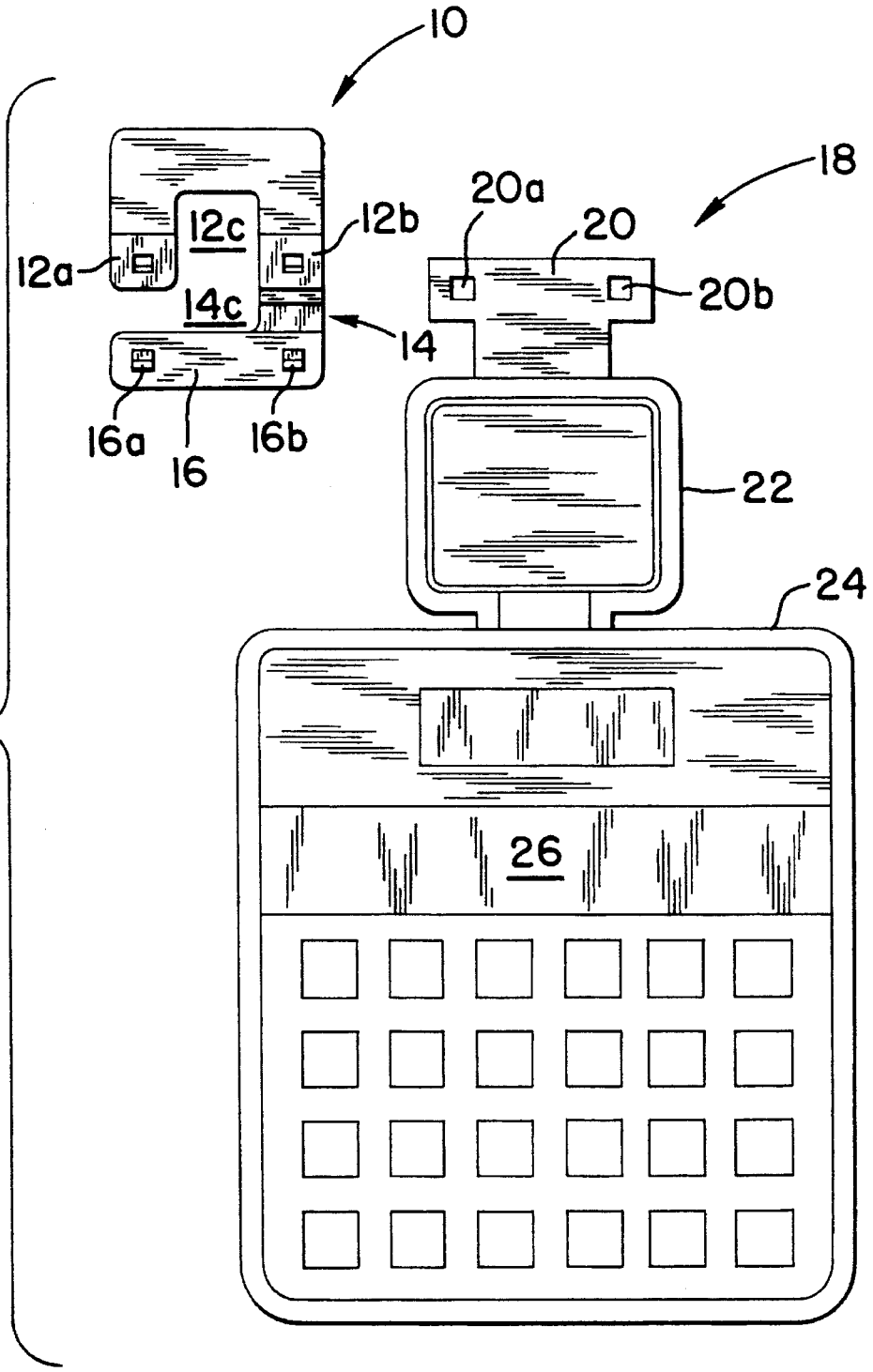
FIG. 3 is a joint front elevation of the primary hanger of FIG. 1 an a first secondary hanger in accordance with the invention, with the secondary hanger containing a first promotional article.

Referring to FIG. 3, primary hanger 10 is shown apart from and aside secondary hanger 18. Secondary hanger 18, also comprised of plastic, includes an uppermost part 20 which is sized to enter sideward opening 14*c* of the fold line segment of the primary hanger and which has openings 20*a* and 20*b* therethrough registrable with the retaining elements 12*a* and 12*b* of the first retaining structure and with the retaining elements 16*a* and 16*b* of the second retaining structure upon folding of flap segment about fold line segment 14. Hanger 18 includes advertising display section 22 and compartment 24, which is shown as containing a calculator as a promotional product.

Figure 4:
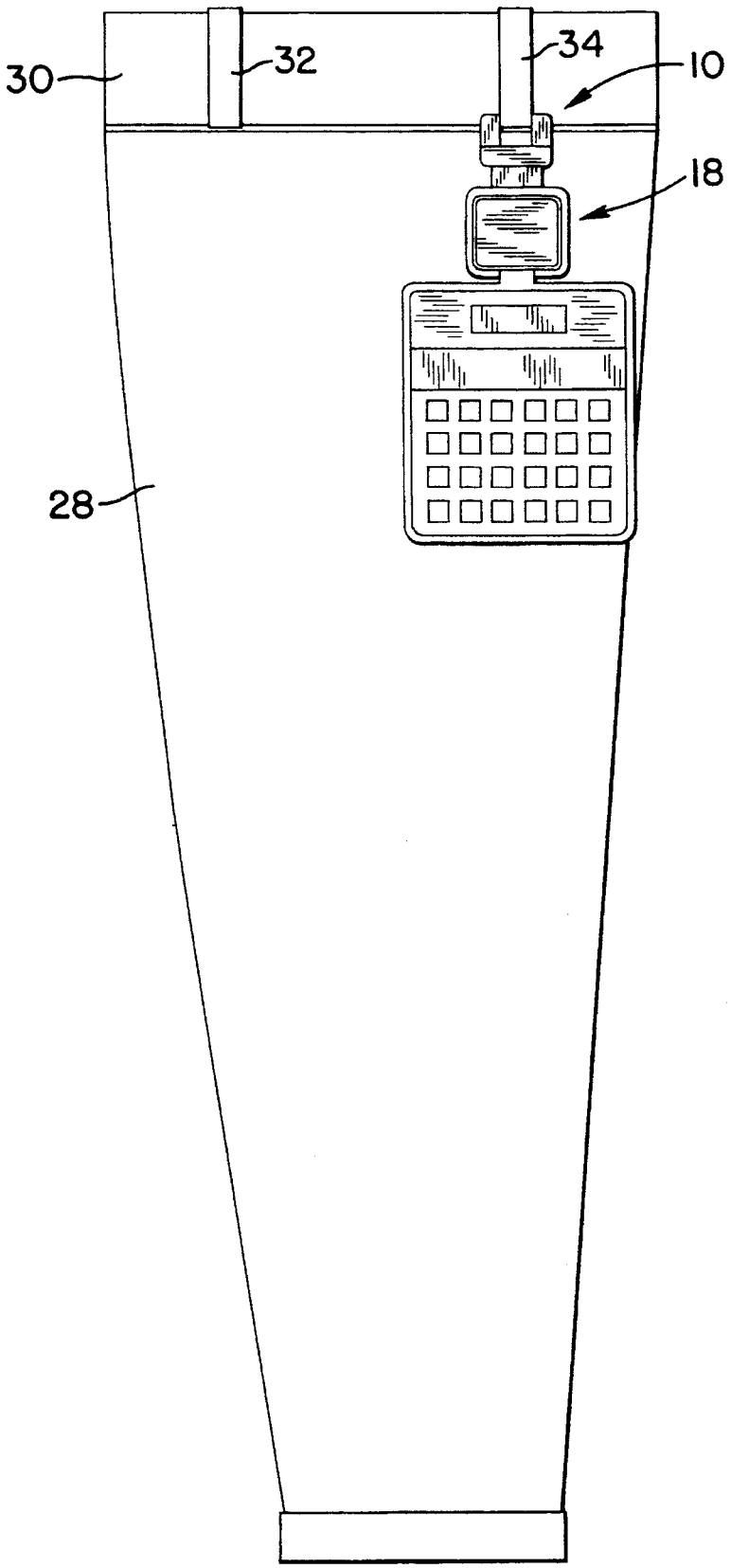
FIG. 4 depicts a trousers to which the hanger composite of FIG. 3 appended by use of a waistband loop of the trousers.

Turning to FIG. 4, trousers 28, an article for sale, has waistband 30 with belt loops 32 and 34, primary hanger 10 being shown in assembly with loop 34 and secondary hanger 18 depending from primary hanger 10 and displaying the promotional calculator below the waistband of the trousers.

Figure 5:
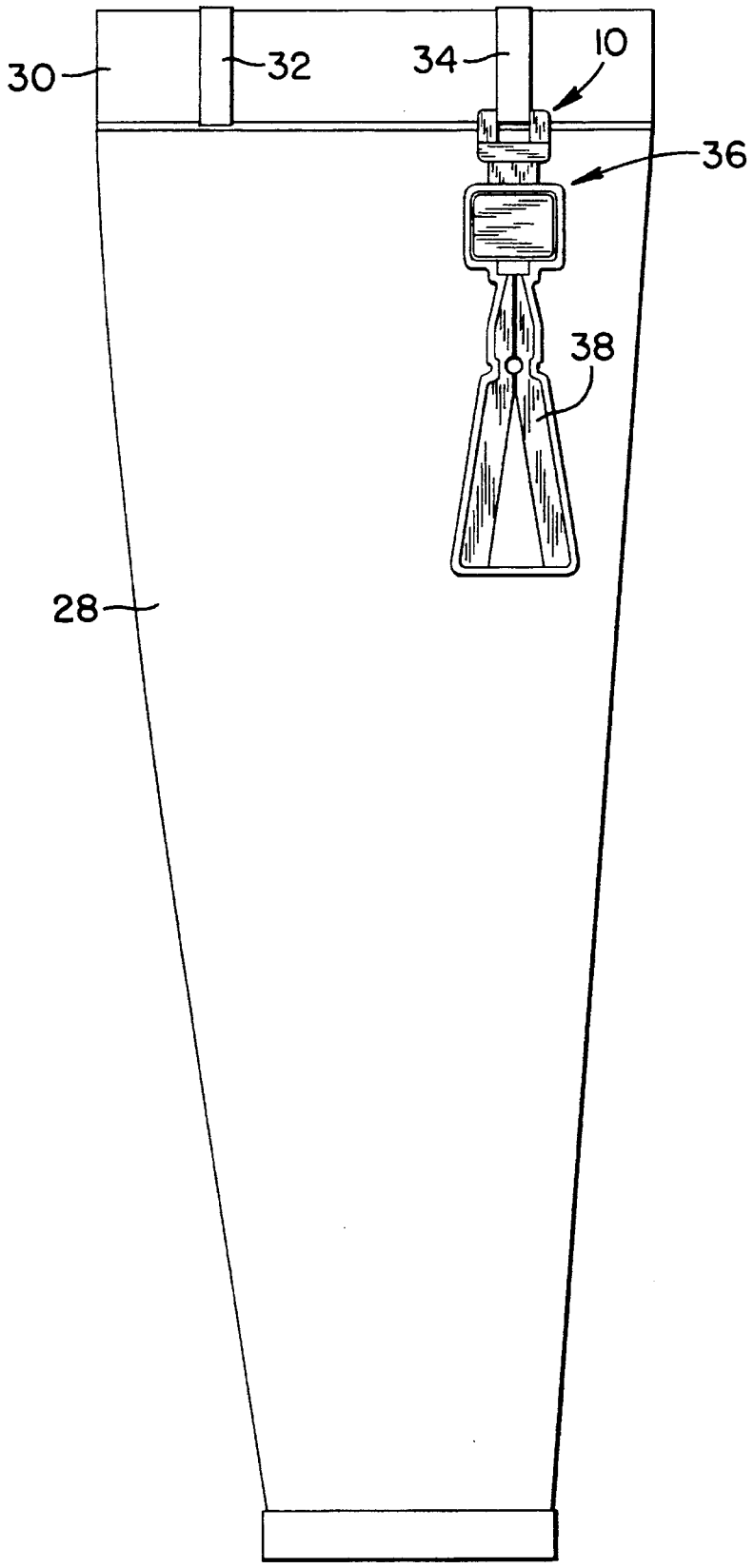
FIG. 5 depicts a trousers to which a further hanger composite of the invention is appended by use of a waistband loop of the trousers.

In FIG. 5, trousers 28 is shown with a further promotional hanger composite wherein primary hanger 10 has secondary hanger 36 depending therefrom, the compartment thereof containing pliers 38.

Figure 6:
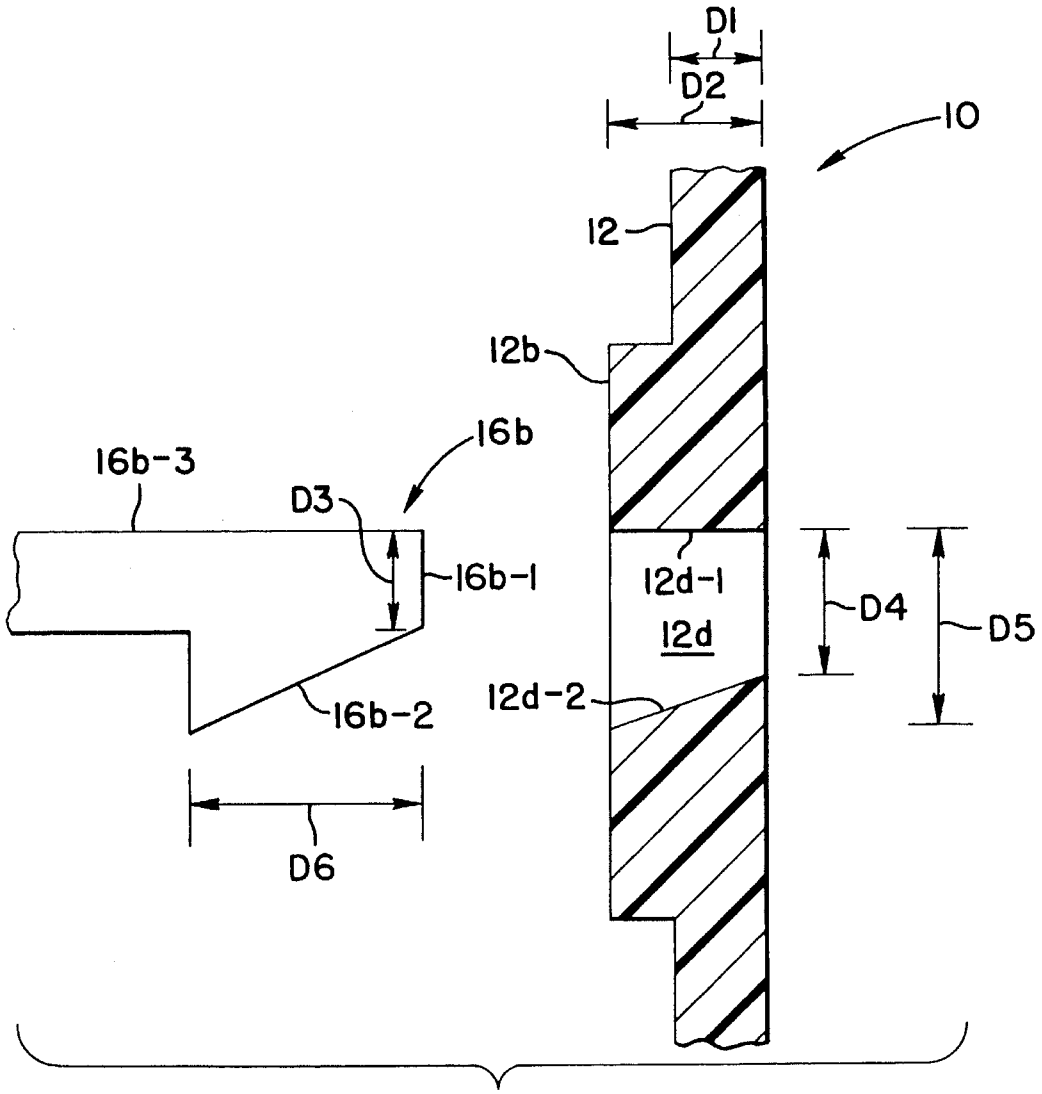
FIGS. 6, 7 and 8 are enlarged partial views depicting the retention structures of the hanger of FIGS. 1 and 2.

Turning to FIG. 6, the rightward portion thereof depicts hanger first part 12 in part and in section, as would be seen from plane VI—VI of FIG. 1. Hanger first part 12 is of thickness D1, except in its increased thickness section 12*b*, where the thickness is D2. The leftward portion of FIG. 6 depicts hanger projection 16*b* in part and unsectioned, the projection having rightward surface 16*b*-1 of dimension D3.

Increased thickness section 12*b* defines aperture 12*d*, which is bounded upwardly by surface 12*d*-1 which is generally orthogonal to the hanger front surface and downwardly by surface 12*d*-2, which is an acute angle to the hanger front surface. At the hanger front surface, aperture 12*d* is of dimension D4 and at the hanger rear surface aperture 12*d* is of dimension D3.

Projection 16*b* has surface 16*b*-2 extending from surface 16*b*-1 at an obtuse angle and has surface 16*b*-3 generally orthogonal to surface 16*b*-1. In the direction of surface 16*b*-3, surface 16*b*-2 extends for dimension D6.

Projection 16*b* is configured to be insertable in aperture 12*d* upon folding of the flap segment about the fold line segment to retentively retain the foldable part in folded condition.

Figure 8:
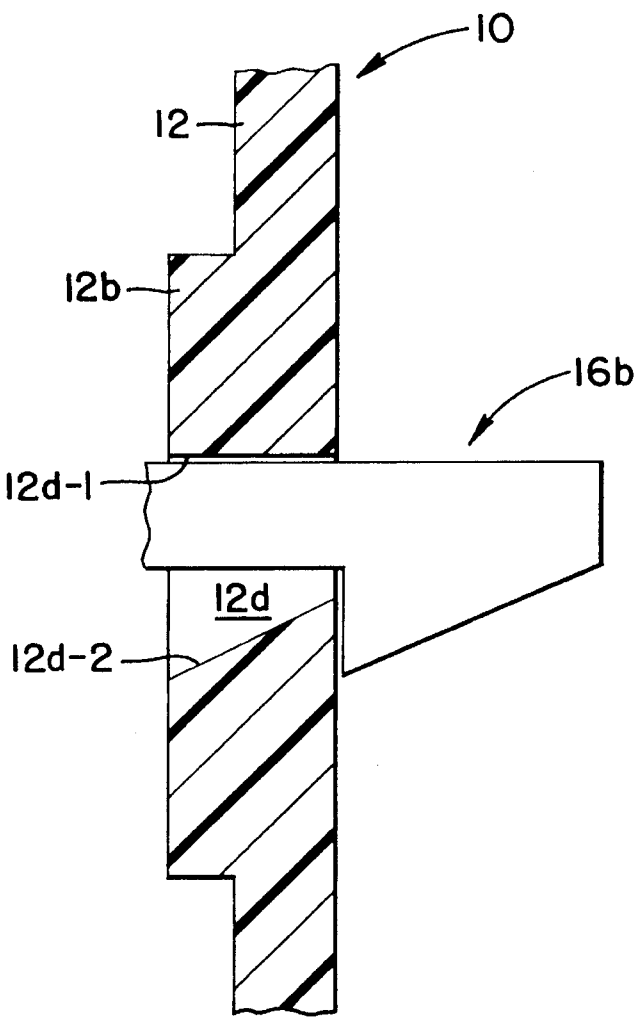
Figure 7:
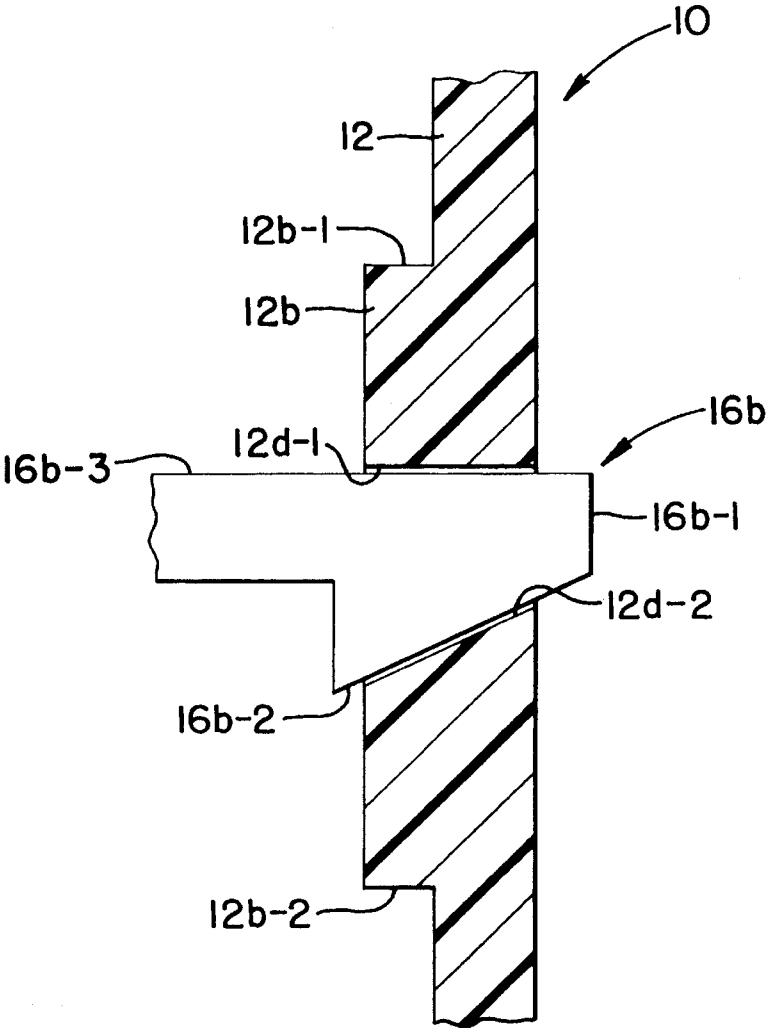

FIG. 7 depicts projection 16*b* in the course of insertion in aperture 12*d* and FIG. 8 depicts the completed phase of insertion.

In reaching the FIG. 8 assembly, projection 16*b* is inserted into aperture 12*d* and forced therethrough. In an initial phase of assembly, as shown in FIG. 7, the complemental configuration of the projection and aperture permits ready, friction-free insertion. Thereafter, the remnant of the projection, i.e., that portion thereof outwardly of the passage (of measure D6-D2) is wedged into the passage. In the course of wedging, thickened part 12*b* expands to facilitate projection entry since it is not bounded by hanger material at its upper and lower limits 12*b*-1 and 12*b*-2.

Figure 10:
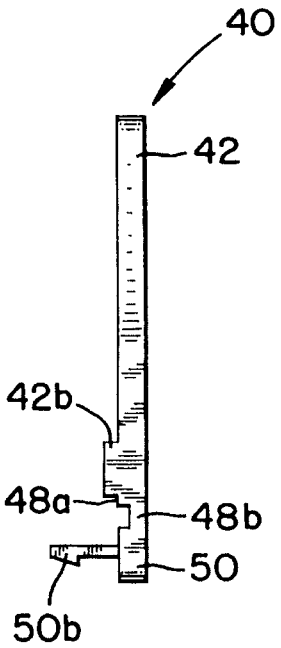
FIG. 10 (PRIOR ART)
FIGS. 9 and 10 are respective front and right side elevations of a prior hanger design of applicants.
Figure 9:
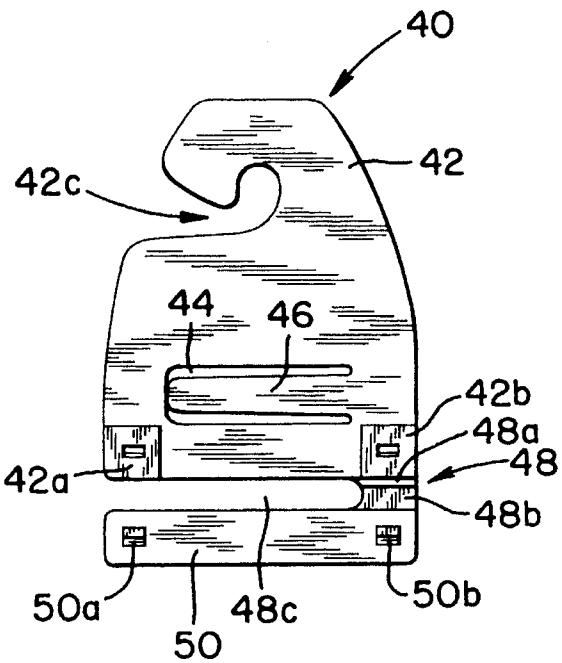
FIG. 9 (PRIOR ART)

As alluded to above, the invention contemplates use of primary hangers other than hanger 10 in reaching hanger composites. Referring to FIGS. 9 and 10, they depict a hanger of the type shown in the above-referenced patent application Ser. No. 279,280, therein used solely in supporting a garment, such as a tie, from a display rod, the hanger being identified by the reference numeral 40.

Hanger 40 is comprised of a one-piece body of plastic having a first part 42 defining a hook portion. At lower extents thereof, part 42 has apertured increased thickness sections 42*a* and 42*b* in accordance with first retaining structure discussed above in connection with FIGS. 6–8 and also defines hanging rod receiving opening 42*c* and includes a central section having aperture 44 therethrough and cantilever-supported member 46.

Hanger 40 includes a second part 48 having diverse thickness portions 48*a* and 48*b* defining a fold line segment of the hanger. Opening 48*c* opens into the left side margin of hanger 40. Hanger 42 differs from hanger 12 particularly in that the lowermost surface between sections 42*a* and 42*b* is continuous and bounds opening 48*c* in contrast to opening 14*c* and hook opening 12*c* being in communication.

Third part 50 of hanger 40 is a flap segment depending from the fold line segment, the flap segment defining second retention structure 50*a* and 50*b* configured as elements projecting outwardly of hanger 40 and configured in accordance with discussion above in connection with FIGS. 6–8. and cooperative with the first retention structure to retain the flap segment with the hook portion upon folding of the flap segment about the fold line segment. The flap segment and the hook portion define a passage therebetween upon the folding of the flap segment about the fold line segment.

Figure 11:
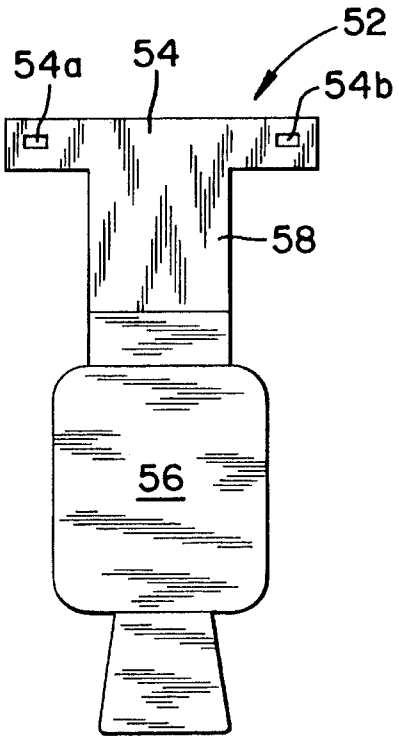
FIG. 11 is a front elevation of a further secondary hanger in accordance with the invention.
Figure 12:
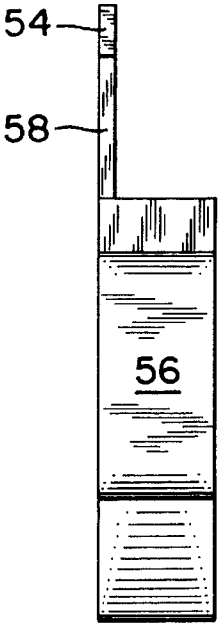
FIG. 12 is a left side elevation of the secondary hanger of FIG. 11.

FIGS. 11 and 12 depict secondary hanger 52, which is comprised of plastic and includes an uppermost part 54 which is sized to enter sideward opening 48*c* of the fold line segment of the primary hanger and which has openings 54*a* and 54*b* therethrough registrable with the retaining elements 42*a* and 42*b* of the first retaining structure and with the retaining elements 50*a* and 50*b* of the second retaining structure upon folding of the flap segment about the fold line segment. Hanger 52 includes advertising display section 58 and compartment 56, which is of configuration for receiving a wristwatch as a promotional product.

Figure 13:
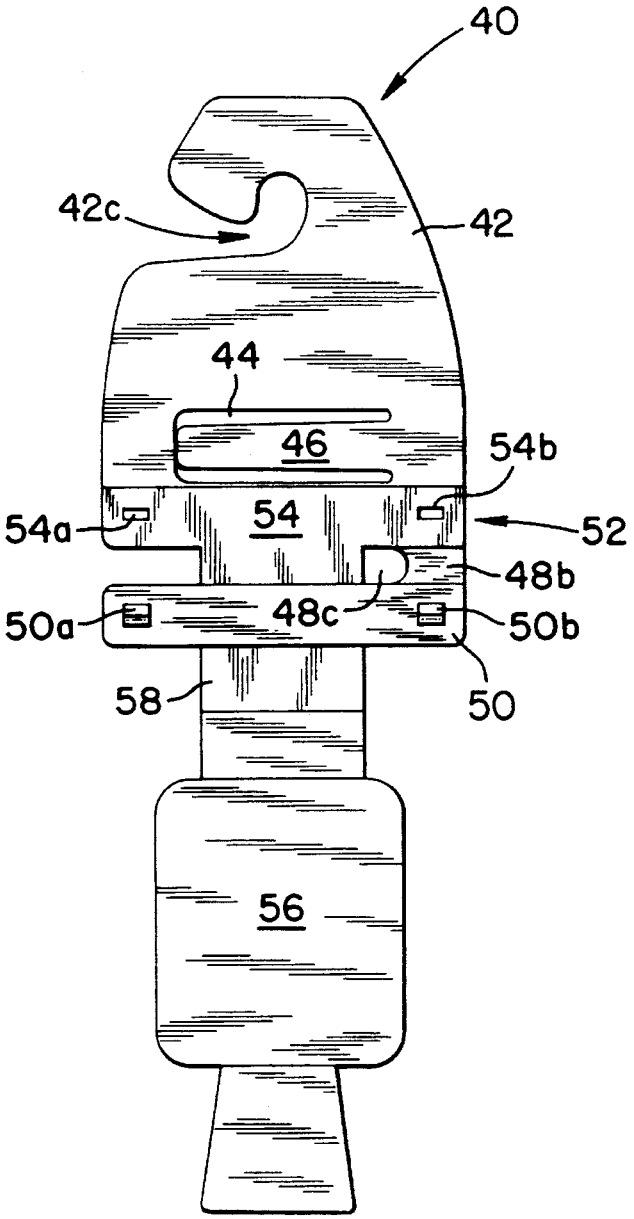
FIG. 13 is a front elevation showing a first assembly stage of the primary and secondary hangers of FIGS. 9–12.
Figure 14:
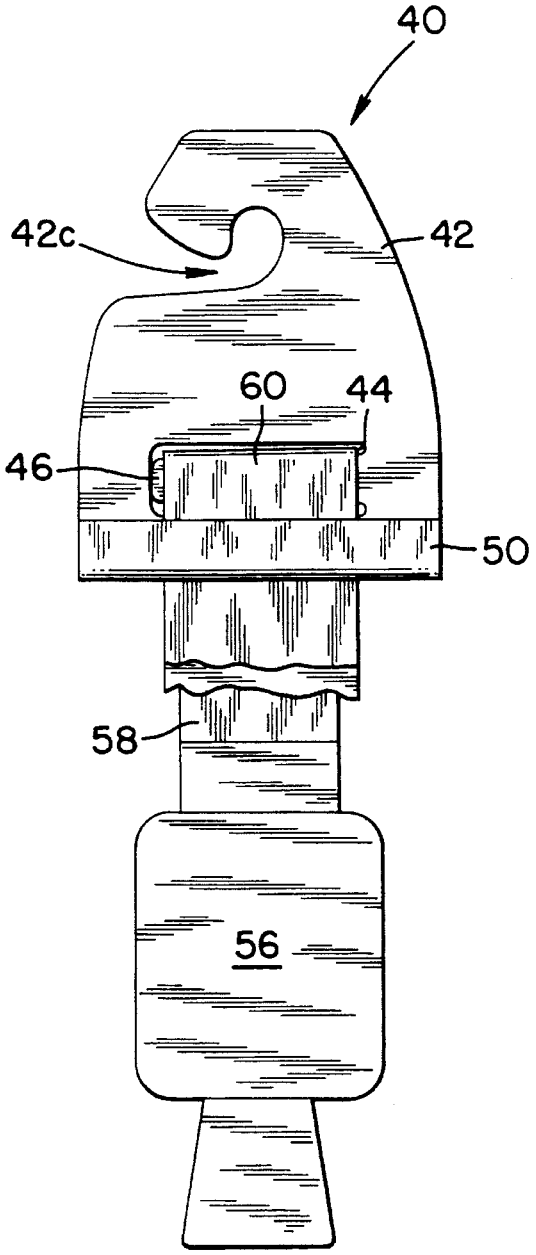
FIG. 14 is a front elevation showing final assembly of the primary and secondary hangers of FIGS. 9–12.

Turning to FIGS. 13 and 14, they show steps in assembling primary and secondary hangers with promotional articles and articles for sale in accordance with the invention.

Secondary hanger 52 is shown in a condition, in FIG. 13, of having its uppermost part 54 inserted into hanger 40 opening 48*c*, and section 58 thereof disposed rearwardly of flap segment 50, with openings 54*a* and 54*b* in registry with first retention structure retaining elements 42*a* and 42*b* of FIG. 6. Compartment 56 extends rearwardly into the plane of FIG. 10.

Tie 60, the article to be sold, is now applied to cantilever-supported member 46 of hanger 40 with the assembly in its FIG. 10 condition, with the tie extending through opening 48*c* forwardly of secondary hanger 52 and then rearwardly of flap segment 50 of hanger 40.

Flap segment 50 is now folded about fold line segment 48 and projections 50*a* and 50*b* are inserted through openings 54*a* and 54*b* and into retention structure retaining elements 42*a* and 42*b*, completing the assembly, as shown in FIG. 11, wherein both tie 60 and secondary hanger 52 are ensnared in the passage between the hanger hook portion and the folded flap segment. Turning the assembly of FIG. 11 fully around, i.e., where hook opening 42*c* is to the right, the assembly can be hung from a display rod with the promotional article being disposed forwardly of the tie.

As will be appreciated the above practice of FIGS. 10 and 11 for assembling primary and secondary hangers in accordance with the invention, is likewise applicable to hanger 10 and the assemblies shown in FIGS. 4 and 5. There, belt loop 34 is disposed in slot 14*c* (FIG. 1) and moved upwardly into hook opening 12*c*. The secondary hanger uppermost portion 20 is inserted then into slot 14*c* and its openings 20*a* and 20*b* are disposed in registry with retention structure retaining elements 12*a* and 12*b*. Flap segment 16 is now folded about fold line segment 14 and projections 16*a* and 16*b* thereof are inserted through the secondary hanger openings 20*a* and 20*b* and into elements 12*a* and 12*b*, ensnaring belt loop 34 and the secondary hanger.

Various changes to the particularly disclosed embodiments and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A hanger comprised of a one-piece body having a first part defining a hook portion having an opening extending therethrough for receiving a hanging support member and defining first retention structure, a second part depending from the hook portion and defining a fold line segment and a sideward opening communicating with the hook portion opening and a third part comprising a flap segment depending from the fold line segment, the flap segment defining second retention structure cooperative with the first retention structure to retain the flap segment with the hook portions upon folding of the flap segment about the fold line segment, the flap segment and the hook portion defining a passage therebetween upon the folding of the flap segment about the fold line segment.

2. The hanger claimed in claim 1, wherein said first and second retention structures each include transversely spaced retaining elements, respectively upwardly and downwardly bounding the fold line segment.

3. The hanger claimed in claim 2, wherein said opening in said hook portion extends transversely between said retaining elements of said first retention structure.

4. The hanger claimed in claim 3, wherein said retaining elements of said first retention structure include respective apertures extending through said hanger and wherein said retaining elements of said second retention structure include respective projections extending outwardly of said hanger.

5. The hanger claimed in claim 2, wherein said retaining elements of said first retention structure include respective apertures extending through said hanger and wherein said retaining elements of said second retention structure include respective projections extending outwardly of said hanger.

6. A hanger composite comprising:

(a) a first hanger including a hook portion having first retention structure, a fold line segment depending from said hook portion and having a sideward opening and a flap segment having second retention structure cooperative with said first retention structure on folding of said flap segment about said fold line segment; and (b) a second hanger having an uppermost part which is sized to enter the sideward opening of the flap segment of the first hanger and which has openings therethrough registrable with the first and second retaining structures to be captured thereby upon folding of the flap segment about the fold line segment, the second hanger thereby being hung from the first hanger.

7. The hanger composite claimed in claim 6, wherein said first and second retention structures each include transversely spaced retaining elements, respectively upwardly and downwardly bounding the fold line segment.

8. The hanger composite claimed in claim 7, wherein said opening in said hook portion extends transversely between said retaining elements of said first retention structure.

9. The hanger composite claimed in claim 8, wherein said retaining elements of said first retention structure include respective apertures extending through said hanger and wherein said retaining elements of said second retention structure include respective projections extending outwardly of said hanger.

10. The hanger composite claimed in claim 7, wherein said retaining elements of said first retention structure include respective apertures extending through said hanger and wherein said retaining elements of said second retention structure include respective projections extending outwardly of said hanger.

11. The hanger composite claimed in claim 6, wherein said second hanger defines a compartment below said uppermost part thereof.

12. A hanger composite comprising:

(a) a first hanger comprised of a one-piece body having a first part defining a hook portion having an opening extending therethrough for receiving a hanging support member and defining first retention structure, a second part depending from the hook portion and defining a fold line segment and a sideward opening communicating with the hook portion opening and a third part comprising a flap segment depending from the fold line segment, the flap segment defining second retention structure cooperative with the first retention structure to retain the flap segment with the hook portion upon folding of the flap segment about the fold line segment, the flap segment and the hook portion defining a passage therebetween upon the folding of the flap segment about the fold line segment; and (b) a second hanger having an upper part which is sized to enter the sideward opening of the flap segment of the first hanger and which has openings therethrough registrable with the first and second retaining structures to be captured thereby upon folding of the flap segment about the fold line segment, the second hanger thereby being hung from the first hanger.

13. The hanger composite claimed in claim 12, wherein said first and second retention structures each include transversely spaced retaining elements, respectively upwardly and downwardly bounding the fold line segment.

14. The hanger composite claimed in claim 13, wherein said opening in said hook portion extends transversely between said retaining elements of said first retention structure.

15. The hanger composite claimed in claim 14, wherein said retaining elements of said first retention structure include respective apertures extending through said hanger and wherein said retaining elements of said second retention structure include respective projections extending outwardly of said hanger.

16. The hanger composite claimed in claim 13, wherein said retaining elements of said first retention structure include respective apertures extending through said hanger and wherein said retaining elements of said second retention structure include respective projections extending outwardly of said hanger.

17. The hanger composite claimed in claim 12, wherein said second hanger defines a compartment below said uppermost part thereof.

* * * * *